US006039427A

United States Patent [19]

Kanome

[11] Patent Number: 6,039,427

[45] **Date of Patent: *Mar. 21, 2000**

[54] RECORDING APPARATUS HAVING DEVIATION ADJUSTING MECHANISM

[75] Inventor: Yuji Kanome, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,390

[22] Filed: Jun. 2, 1997

Related U.S. Application Data

[63] Continuation of application No. 08/262,841, Jun. 21, 1994, abandoned.

[30] Foreign Application Priority Data

Jun. 22, 1993 [JP] Japan ..... 5-150637

[51] Int. Cl.[7] ..... B45J 29/393

[52] U.S. Cl. ..... 347/19

[58] Field of Search ..... 347/12, 19, 37, 347/41, 43, 8; 358/504, 406; 400/59

[56] References Cited

U.S. PATENT DOCUMENTS 5,289,208 2/1994 Haselby ..... 347/19

FOREIGN PATENT DOCUMENTS 0257570 3/1988 European Pat. Off. .
0469854 2/1992 European Pat. Off. .
0540245 5/1993 European Pat. Off. .
4015799 11/1991 Germany .
60-208255 10/1985 Japan .
63-037978 2/1988 Japan .
63-153151 6/1988 Japan ..... 347/19
63-280671 11/1988 Japan .
02190367 7/1990 Japan .
02243373 9/1990 Japan .
03146378 6/1991 Japan .
03234668 10/1991 Japan .

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording apparatus, in which a recording operation is carried out while a recording head having a plurality of recording elements arranged in a line is reciprocated, includes a pattern printing device for printing adjustment patterns through a plurality of reciprocations, in which drive timings of the plurality of recording elements of the recording head are different so that a relative position between an odd number line and an even number line in a direction of the reciprocation, are slightly deviated; and an adjusting device for adjusting printing positions between forward and backward printing operations, by controlling the drive timings of the recording elements in accordance with deviation in the adjustment pattern provided by the pattern printing device.

17 Claims, 16 Drawing Sheets

(ENLARGED)

RECORDING APPARATUS HAVING DEVIATION ADJUSTING MECHANISM

This application is a continuation of application Ser. No. 08/262,841 filed Jun. 21, 1994, now abandoned.

FIELD OF THE INVENTION AND RELATED ART

The present invention relates to a recording apparatus having a recording head having a plurality of recording elements aligned on a line.

A so-called serial type recording apparatus (serial printer) having a carriage carrying a recording head reciprocable in a direction perpendicular to a sheet feeding direction in which paper, OHP sheet, or another recording material is fed, uses various types of carrying methods of the recording head. The recording head used in the serial printer may be a wire dot type, heat-sensitive type, thermal transfer type, ink jet type or the like. Among the various types of serial printers, the ink jet type is advantageous in that the running cost is low because the ink is directly ejected on the recording sheet, and the noise in recording is small. In the ink jet type, the recording head is spaced from a recording material (non-contact type) and the load required for moving the carriage is low, and therefore, is advantageous in high speed printing. In addition to that, the limitation to the printing direction is smaller than in the thermal type, and therefore, bi-directional printing can be easily accomplished. In addition, since the ink is ejected only to the required portion, color printing with low running cost is easy. For these reasons, it is particularly notable.

Conventionally, when a vertical line is to be printed as shown in FIG. 14, in the serial type printer, the lines printed for each line are inclined if the recording head is not positioned correctly on the carriage, and therefore, the recorded line is not straight.

In a printer having a built-in recording head (permanent type) in which the positional relation between the recording head and the carriage are definitely determined, the inclination can be avoided by increasing the accuracies of the parts and assembling accuracy and by making adjustment for individual printers during assembling operation. However, there arises a problem that the cost of parts is increased, and the detection of the inclination of the printing is difficult with the result of long time adjustment with the result of higher assembling cost.

Particularly, in a printer using a replaceable recording head in which the positional relation between the recording head and the carriage is not definitely determined, the above-described adjustment during the assembling operation is unavailable. For this reason, there arises a problem of crooked vertical lines due to the variation of the recording head and the variation in the mounting position between the recording head and the carriage.

Furthermore, in the case of bi-directional printing, the print position is deviated between in the forward printing and backward printing direction due to the delay of rotation relative to the motor driving signal which is a driving source for driving the carriage, and/or the backlash between gears for transmitting the driving force, and therefore, the printing positions in the forward stroke and the backward stroke are to be adjusted.

As a method of this adjustment, there is a method in which, as shown in FIGS. 15A–15C, several different patterns in which an even number line (or odd number line) printing position is slightly deviated relative to an odd number line (even number line) printing position, are printed for one reciprocation, and one of the patterns with which the forward and backward printing positions are most aligned is discriminated, and the reciprocal printing positions are adjusted. Here, the reason why the vertical line, that is, the recording head, is inclined is that the printing position deviation due to the time difference upon the time shared driving of the recording elements of the recording head is to be corrected.

With this method, however, if the user erroneously selected No. 1 pattern despite the fact that No. 3 pattern is the best, the reciprocal printing position adjustment is not correctly carried out.

SUMMARY OF THE INVENTION

Accordingly, it is a principal object of the present invention to produce an image in which the vertical lines are straight.

It is another object of the present invention to provide a recording apparatus with which the vertical line is not inclined or crooked.

It is a further object of the present invention to provide a recording apparatus in which the printing portions are not deviated between the forward printing and the backward printing.

According to an aspect of the present invention there is provided a recording apparatus in which recording operation is carried out while a recording head having a plurality of recording elements arranged on a line is reciprocated, comprising: pattern printing means for printing adjustment patterns through a plurality of reciprocations, in which drive timings of the plurality of recording elements of the recording head are different so that relative positions between an odd number line and an even number line in a direction of the reciprocation, are slightly deviated; and adjusting means for adjusting positions between forward and backward printing operations, by controlling the drive timings of the recording elements in accordance with deviation in the adjustment pattern provided by the pattern printing means.

According to another aspect of the present invention, there is provided a recording method for reciprocating a recording head provided with a plurality of recording elements arranged on a line, comprising the steps of: printing a first adjustment pattern comprising a plurality of vertical lines by driving a plurality of recording elements of the recording head at a first drive timing, while moving the recording head in a first direction; printing a second adjustment pattern comprising a plurality of vertical lines by driving the recording elements at second drive timing, while moving the recording head in a second direction, wherein the second direction is opposite from the first direction, wherein the second drive timing is different from the first drive timing; printing a third adjustment pattern comprising a plurality of vertical lines by driving the recording elements at the first drive timing, while moving the recording head in the first direction; adjusting drive timings for driving the recording elements in accordance with deviations among first, second and third adjustment patterns; and driving the recording elements in accordance with the adjusted drive timing to print data.

According to a further aspect of the present invention, there is provided a recording apparatus in which recording operation is carried out while a recording head having a plurality of recording elements arranged on a line is reciprocated, comprising: pattern printing means for printing adjustment patterns through a plurality of reciprocations, in which drive timings of the plurality of recording elements of the recording head are different so that relative positions between an odd number line and an even number line in a direction of the reciprocation, are slightly deviated; and adjusting means for adjusting printing inclination deviation by controlling the drive timings of the recording elements in accordance with inclination in the adjustment pattern provided by the pattern printing means.

By printing the adjusting pattern, the print inclination can be easily calculated, and the print inclination can be adjusted by controlling the drive timing of the recording element of the recording head.

In a recording apparatus in which reciprocable printing is possible, the reciprocal printing position adjustment can be correctly carried out using the adjusting pattern even in a printing apparatus with printing inclination, and in addition, by determining the condition where forward and backward printing positions are in accord with each other in 1.5 reciprocation (3 lines) and 1 reciprocation (2 lines), the amount of inclination of the recording head can be easily determined, and therefore, the printing inclination can be adjusted.

Thus, the recording apparatus capable of high quality printing without vertical line deviation due to the printing inclination, can be provided. Furthermore, a recording apparatus capable of effecting bi-directional printing in which high quality printing is possible without reciprocal printing position deviation and the printing inclination can be avoided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
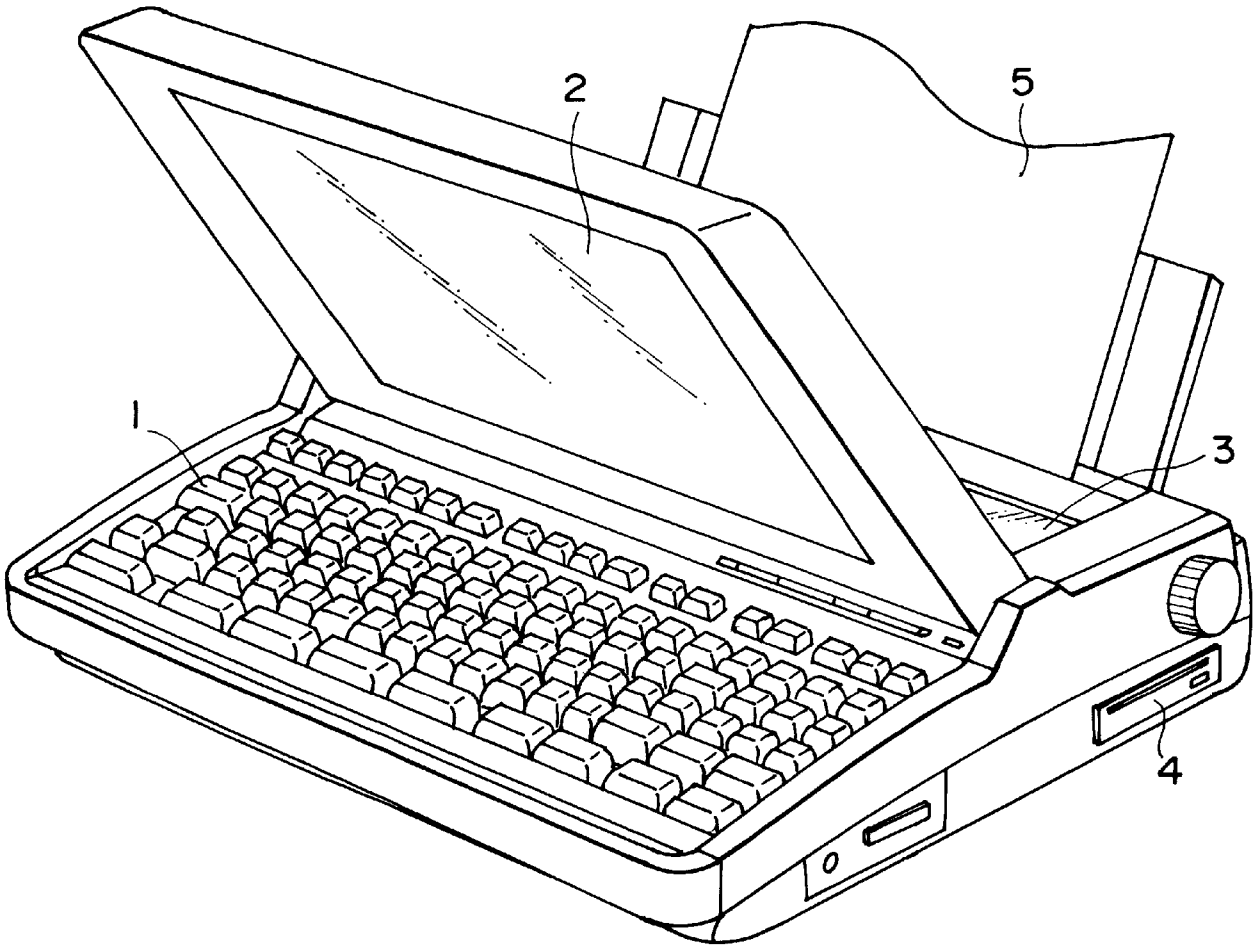
FIG. 1 shows a perspective view of a word processor provided with a recording apparatus according to an embodiment of the present invention.
Figure 2:
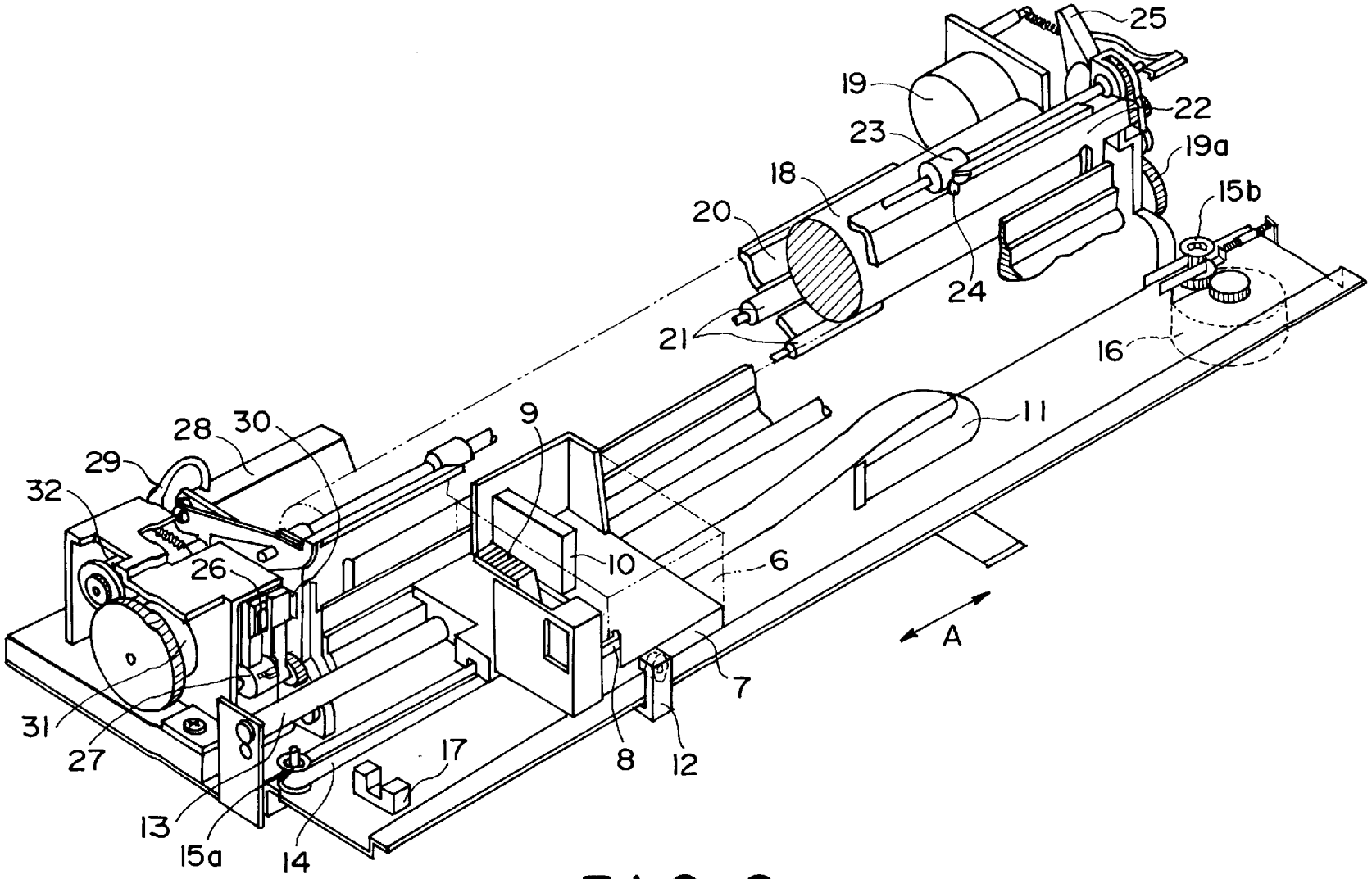
FIG. 2 is a perspective view of a recording apparatus according to an embodiment of the present invention.

Referring to FIG. 1, there is shown a perspective view of a word processor as an exemplary recording apparatus according to an embodiment of the present invention. FIG. 2 illustrates structures of the recording apparatus of this embodiment.

First, the entirety of the apparatus will be described. As shown in FIG. 1, the apparatus comprises a keyboard 1 for inputting information, a display of LCD type for displaying input information, a floppy disk driver 4 for storing input information, and a recording apparatus for recording the inputted information on the recording material 5. When character information or the like is inputted on the keyboard 1, the inputted information is displayed on the display 2. In order to output the information, a recording material 5 is set in the recording apparatus 3, and when the record start key is depressed, the recording apparatus is driven, and the information is recorded on the recording material thus set.

The recording apparatus, as shown in FIG. 2, comprises a head cartridge 6 having an ink jet recording head, a carriage 7 for reciprocating the cartridge in a direction A, a hook 8 for mounting the head cartridge 6 on the carriage 7, a lever 9 for operating the hook 8, a support 10 for supporting an electrical connection portion relative to the head cartridge 6, a flexible cable 11 for connecting the electrical connection portion and a controller of the main assembly of the recording apparatus, a slider 12 for preventing rise of the carriage 7 by the flexible cable 11, a guide (carriage shaft) 13 for guiding the carriage 7 in a direction A, a timing belt 14 fixed to the carriage 7 and for transmitting the driving force for the movement in the A direction, and pulleys 15*a* and 15*b* disposed at the opposite ends of the apparatus and on which the timing belt is stretched. On the other hand, a driving force is transmitted to one of the pulleys 15*b* through transmitting mechanisms, such as gears or the like, from the carriage motor 16, by which the carriage is moved to scan in accordance with the recording data over the recording area and the non-recording area.

Designated by a reference numeral 17 is a detector for detecting a print home position and a recovery operation home position. It is in the form of a transmitting type optical sensor.

Designated by a reference numeral 18 is a feeding roller for confining a recording surface of a recording material such as paper and for feeding the recording material during the recording operation. It is driven by a feeding motor 19. Designated by 20 is a paper pan for introducing the recording material to the recording position. A pinch roller 21 is disposed in the feeding path of the recording material and urges the recording material to the feeding roller 18 to feed it. A platen 22 is faced to ejection outlets of the head cartridge 6 to confine the recording surface of the recording material. Discharging roller 23 is disposed downstream of the recording position with respect to the feeding direction of the recording material, and is effective to discharge the recording material to an unshown discharging outlet. Spurs 24 are provided to the discharging roller and function to urge the recording material to the discharging roller 23 to assure that the recording material is fed by the discharging roller 23. A releasing lever 25 is provided to release the urging between the pinch roller 21 and the spurs 24 to permit setting of the recording material.

A cap 26 is formed with elastic material such as rubber and is faced to the ink ejection outlet side of the recording head at the home position. It is supported for contact and non-contact relative to the recording head. The cap 26 is used for the purpose of protecting the recording head when the recording operation is not carried out, or the like, or for the purpose of ejection recovery operation for the recording head. The ejection recovery operation includes an operation in which energy generating elements for ink ejection are driven through all of ejection outlets while they are capped by the cap 26, by which bubbles, foreign matter, viscosity-increased ink or the like or other improper ejection factors are removed (preliminary ejection), and an operation in which the ejection side surface is covered by the cap 26, and the ink is forcibly discharged through the ejection outlet in another method to remove the improper ejection factor.

A pump 29 functions to provide suction force for the forced ink discharge and also functions to suction the ink received by the cap 26 during the ejection recovery operation by the forced discharge and the ejection recovery operation by the preliminary ejection. A discharge ink container 28 functions to accommodate the ink suctioned and discharged by the pump. A tube 29 is effective to communicate the pump and the discharged ink container 28. Designated by 30 is a blade for wiping the ink ejection outlet side surface of the recording head. It is supported for movement between a wiping position in which it is projected to the recording head to wipe the recording head during movement thereof, and a retracted position out of contact with the ejection side surface.

A cam 31 receives driving force from a motor 32 to drive the pump 27, cap 26 and the blade 30.

The description will be made as to the head cartridge 6 and the method of setting the head cartridge 6 on the carriage 7.

Figure 3:
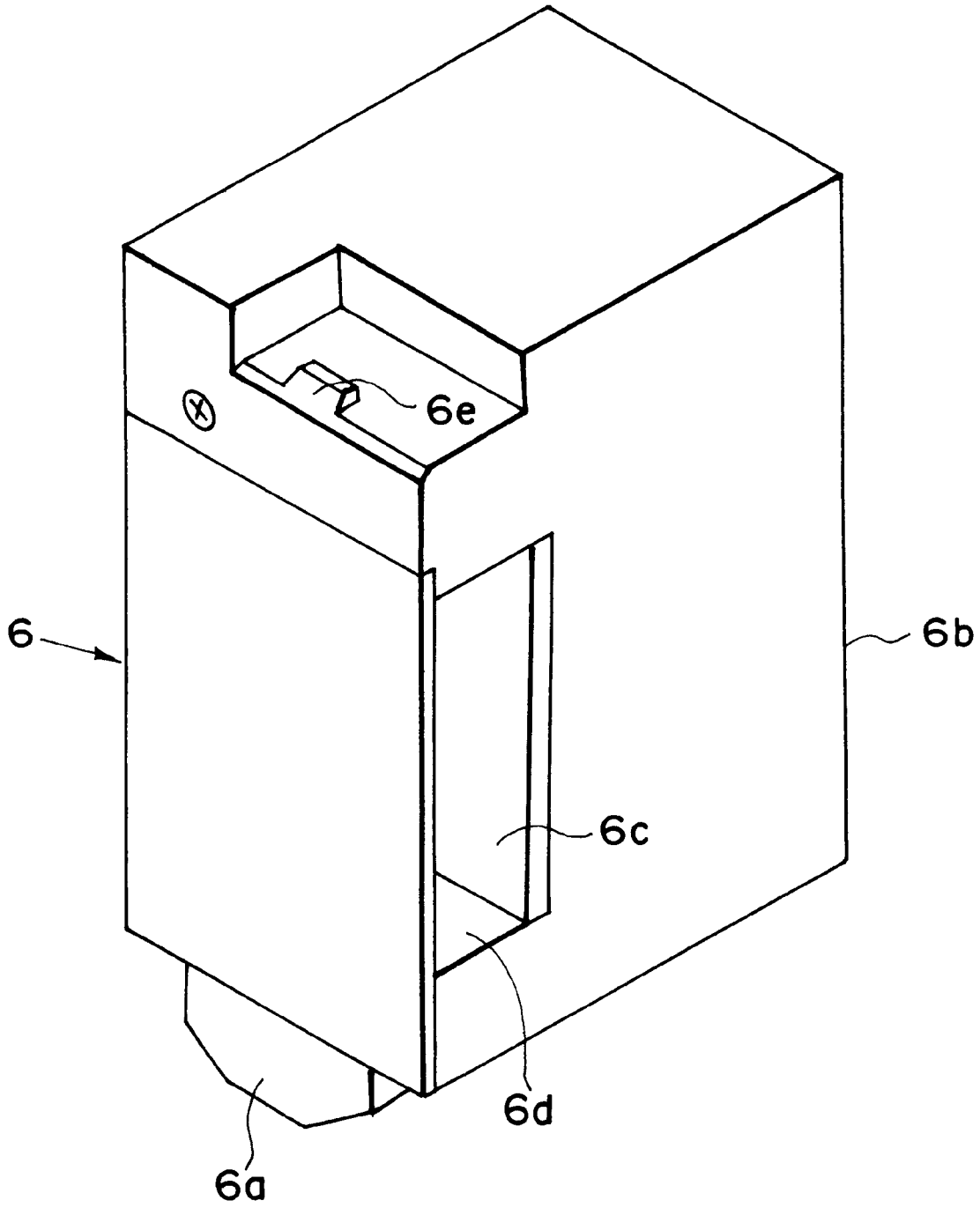
FIG. 3 is a perspective view of a head cartridge carried on a recording apparatus of this embodiment.

FIG. 3 shows an outer appearance of a head cartridge 6 integrally having an ejection unit 6*a* (main body of the ink jet recording head) and an ink container 6*b*. In the Figure, a claw 6*e* is engageable with a hook 8 on the carriage 7 when the head cartridge 6 is mounted. As will be understood from the Figure, the claw 6*e* is inside the entire length of the recording head. Adjacent the front ejection unit 6*a* of the head cartridge 6, there is provided an abutment 6*f* (FIG. 4) for positioning, although not shown in the Figure. An opening 6*d* is to receive a supporting plate 10 for supporting a flexible substrate (electrical connecting portion or flexible cable) mounted perpendicularly to the carriage 7. Ejection heaters (electrothermal transducer elements or recording elements) 6*c* are integral with the ejection unit 6*a* and function to eject the ink, it also functions as a wiring board for electrical connection with the flexible cable 11 for supplying electric energy to the ejection heaters.

Figure 4A:
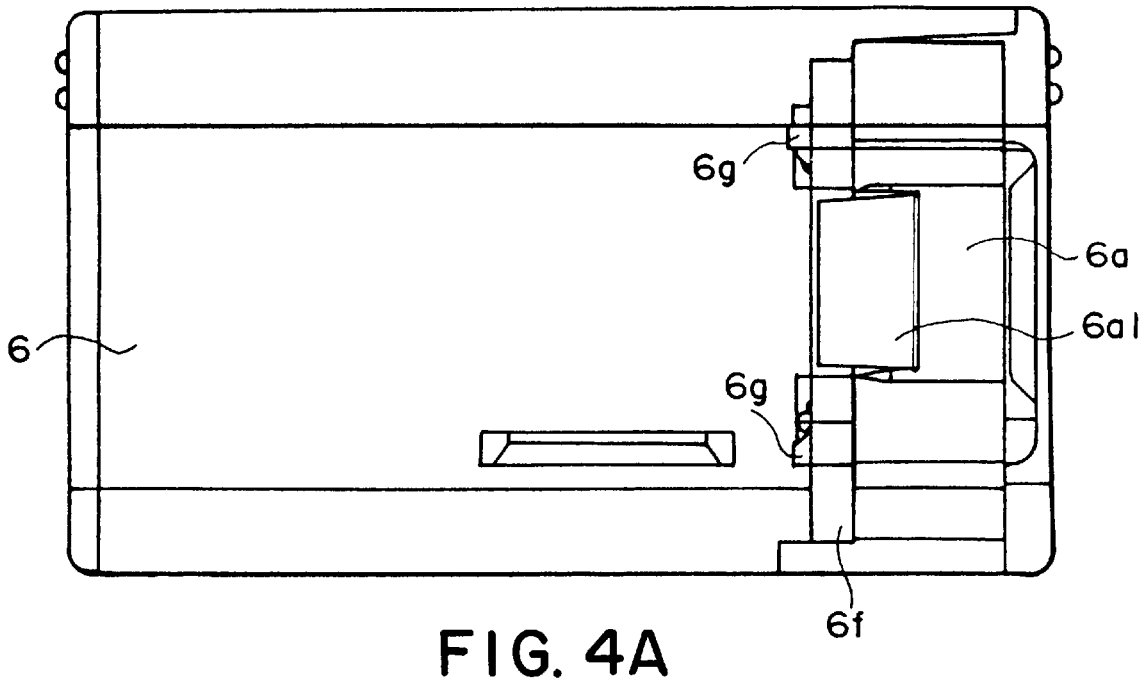
FIGS. 4A and 4B illustrate details of an ejection unit of a head cartridge carried on the recording apparatus of this embodiment.
Figure 4B:
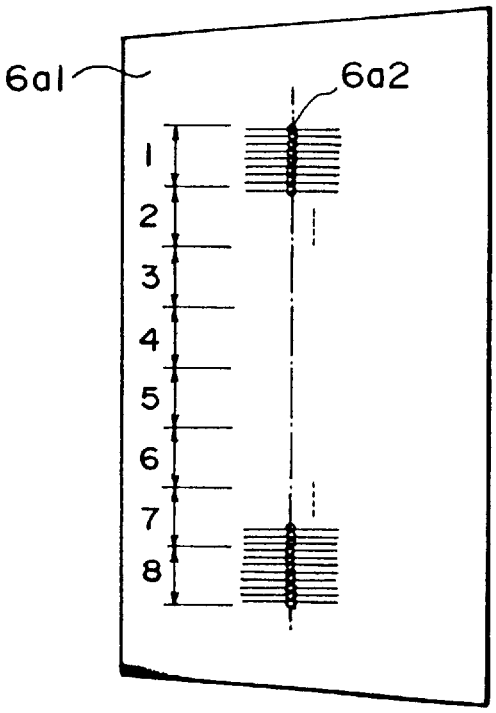

FIGS. 4A and 4B show in detail the ejection unit 6*a* of the recording head 6. In a surface 6*a*1 faced to the recording sheet 5 of the ejection unit 6*a*, 64 fine nozzles 6*a*2 for ejecting ink droplets are formed at regular intervals. The resolution is 360 dpi. The nozzle is constituted by 8 blocks, each block being constituted by 8 nozzles (64 nozzles in total). The heat timing is controllable for respective blocks.

Figure 5:
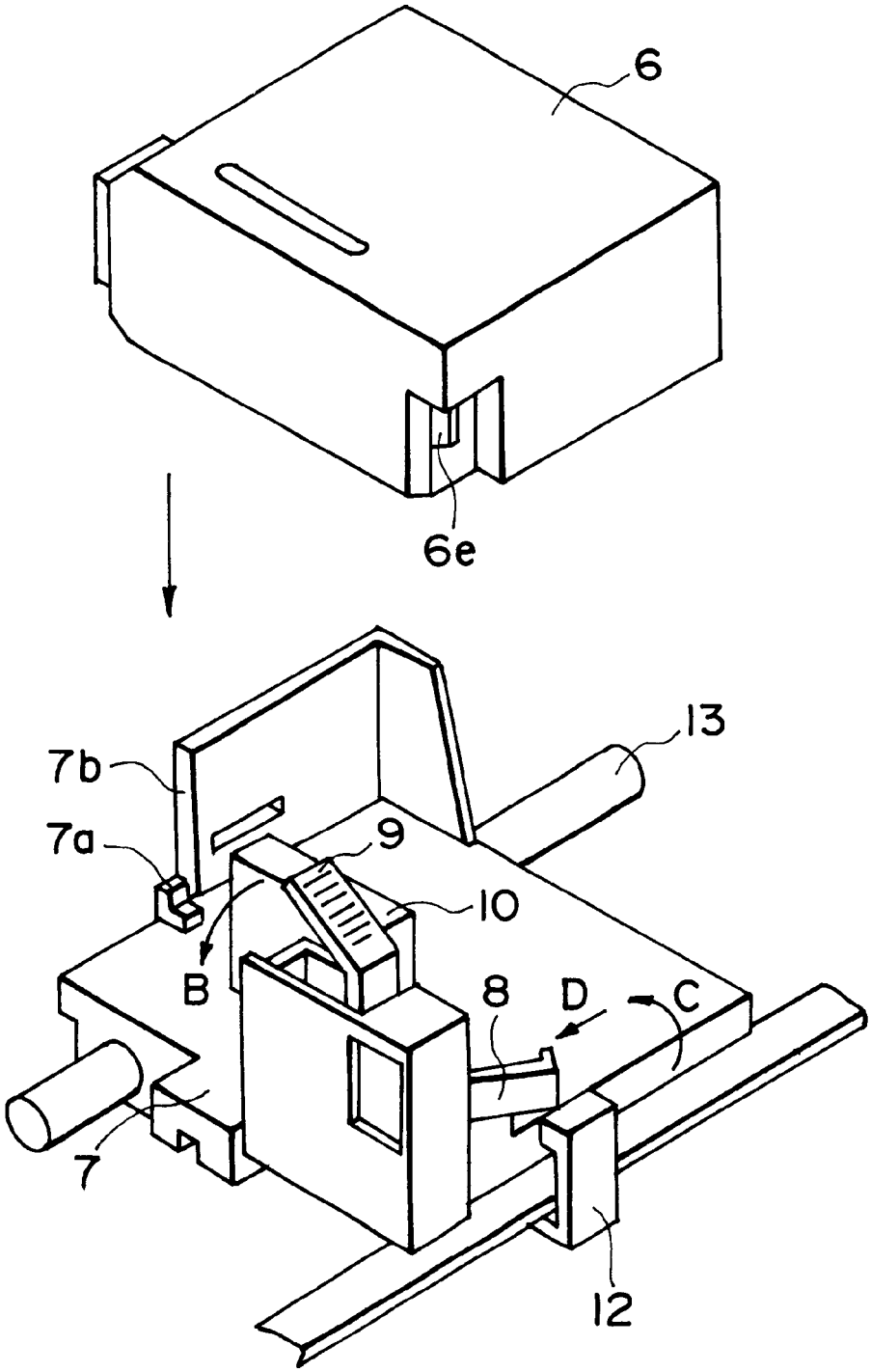
FIG. 5 illustrates a method of setting a head cartridge on a carriage in this embodiment.

FIG. 5 shows the method of setting the head cartridge 6 on the carriage 7. The head cartridge 6 is mounted on the carriage 7 such that the supporting plate for supporting the flexible cable 11 perpendicularly mounted to the carriage 7 is inserted into the opening 6*a* of the head cartridge 6. Then, the lever 9 is rotated in direction B. In interrelation with this, the hook 8 first rotates in the direction C, and it is brought into engagement with the claw 6*e* of the head cartridge 6. When the lever 9 is further rotated in direction B, the hook 8 is drawn in a direction D while it is engaged with the claw 6*e*. In interrelation with these operations, an abutment portion 6*f* (FIG. 4A) of the head cartridge is abutted to the positioning portion 7*a* of the carriage, so that the positioning is accomplished so as to provide a constant space from the recording sheet 5. A positioning portion 6*g* for positioning in a direction perpendicular to the carriage scanning direction (arrow A in FIG. 2) of the head cartridge 6 (the positioning portion 6*g* is constituted by two projections which are disposed on a line parallel to a center line of the nozzles) is correctly positioned in a direction substantially perpendicularly to the carriage scanning direction by abutment to a positioning portion 7*b* of the carriage 7.

The description will be made as to the feeding mechanism for the recording material.

Figure 6:
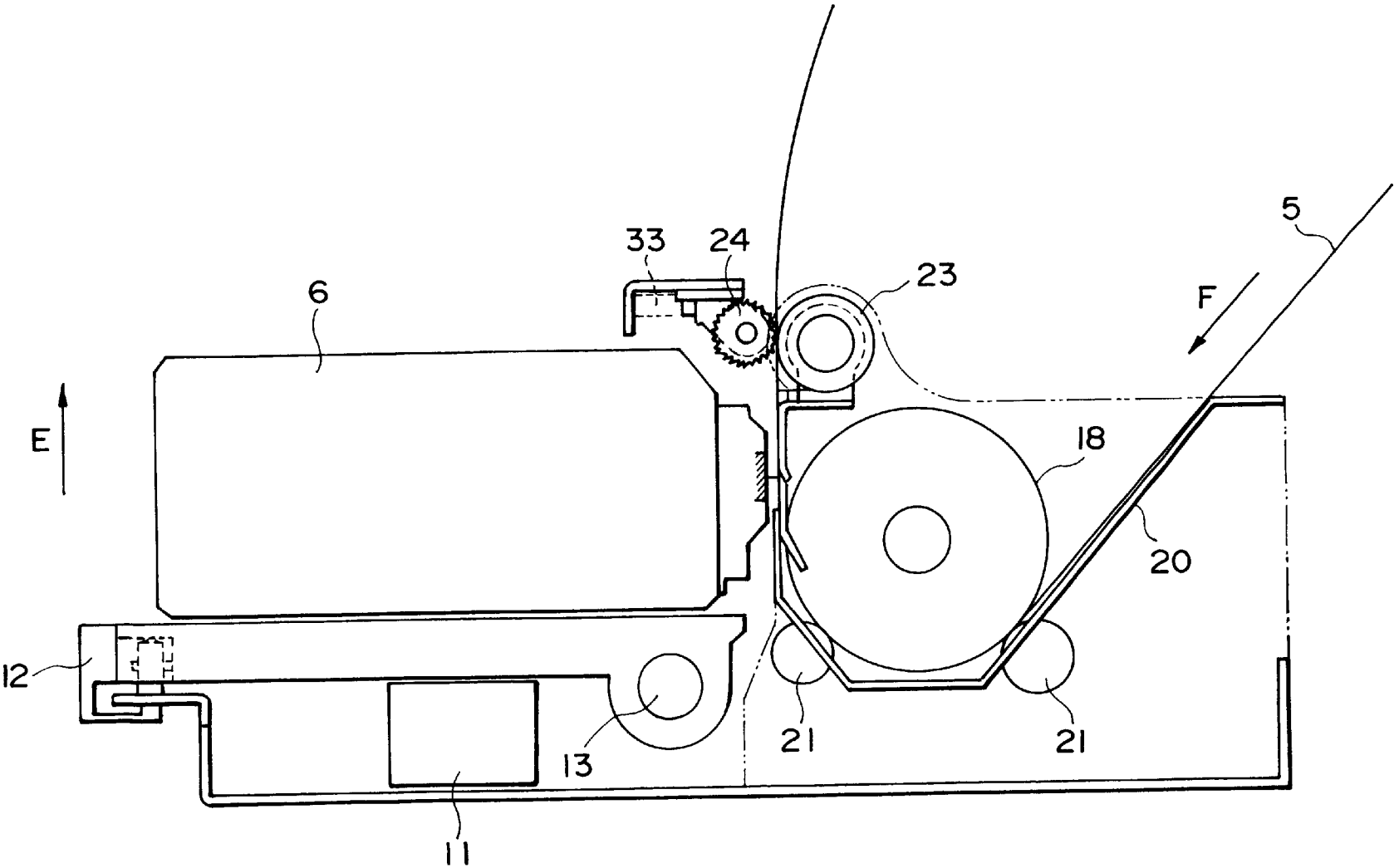
FIG. 6 is a right side view of a recording apparatus of this embodiment.

FIG. 6 is a right side view illustrating detailed structure of the carriage.

A slider 12 is mounted in the carriage to prevent rise of the carriage 7 by the flexible cable 11 toward the upward direction (arrow E).

In FIGS. 2 and 6, a pinch roller 21 is urged by an unshown spring to the feed roller 18 extended in a direction parallel to the guide 13. A recording material 5 inserted through an unshown opening is fed in a direction of arrow F (FIG. 6) by the urging force of the pinch roller 21, and is supported at a position faced to the recording head 6. The recording material 5 is further fed after the printing in the direction of arrow F (FIG. 6) by the feeding roller 8 to reach the discharging roller 23 to which spurs 24 are urged by a spring 33, and is discharged to an unshown discharge opening.

The feeding roller 18 is connected with a feeding motor 19 by way of gear trains 19*a*, and the feeding roller 18 is rotated by driving the feeding motor 19.

Control means for controlling the recording apparatus will be described.

Figure 7:
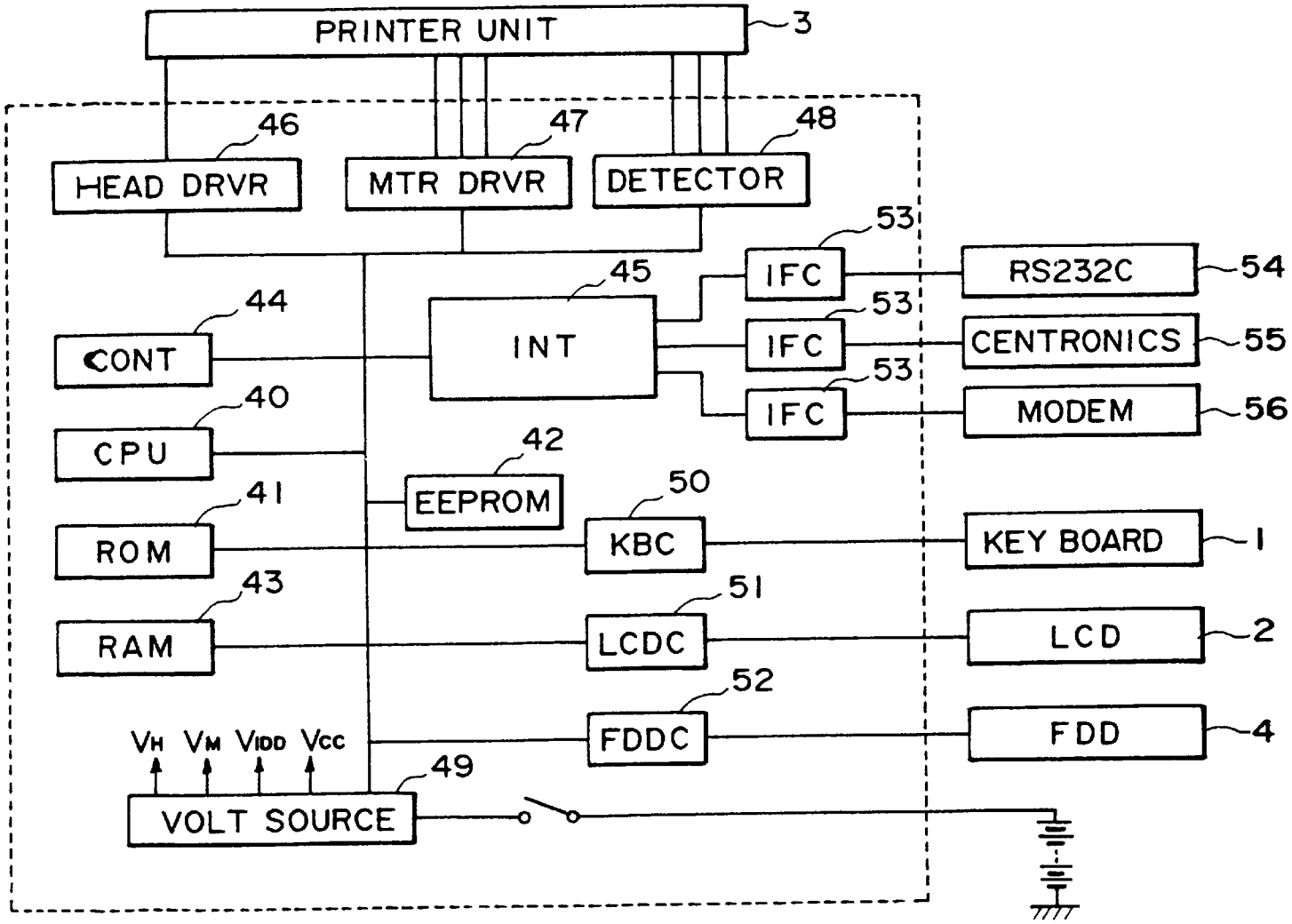
FIG. 7 is a block diagram of a control system of this embodiment.

FIG. 7 is a block diagram of a control system, in which only connections between blocks are shown, and detailed control lines are omitted. A CPU unit is illustrated as a portion enclosed by broken lines.

The CPU 40 is a central processing unit that functions to read out various data from a floppy disk or ROM 41 which will be described hereinafter, and functions to effect necessary calculations, determinations and various controls.

The ROM 41 is a read only memory, and stores various programs for operating the CPU 40, character codes, dot patterns (character generator; CG) or other necessary data required for effecting the recording operation.

EEPROM 42 is an electrically rewritable read only memory, which stores data inherent to an individual machine such as an adjusting value for the print inclination and an adjusting value for the reciprocal printing positions or the like. RAM 43 is a read/write memory and comprises a working area for temporarily storing data or calculation results instructed by the CPU 40, a buffer area for storing various data inputted from external interface 45 or floppy disk driver 4 or the like, and a text area for storing documents. The CPU unit is connected with a printer unit 3 through a recording head driver 46, a motor driver 47 and a detector 48.

A recording head driver 46 drives a recording head 6 mounted on the printer unit 3 under the control of CPU 40, a motor driver 47 drives the feeding motor 19, the carriage motor 16 and the recovery operation motor 32 under the control of CPU 40.

A detector 48 functions to transmit to the CPU 40 a detection signal from paper sensor for detecting presence or absence of the recording material, provided on a printer unit 3.

Voltage source 49 functions as recording head driving source VH, voltage source VM for driving feeding motor 19, carriage motor 16 and recovery operation motor 32, a voltage source VFDD for driving the floppy disk driver 4 and a voltage source VCC for the logic circuit. The controller 44 functions to transfer the recording data to the recording head 6 under the control of the CPU, to change voltage and current from the driving source VH or to effect other control.

The CPU unit is connected with a keyboard 1 for inputting various data required for recording or editing or the like through a keyboard connector (KBC) 50. The CPU unit is connected with a display 2 constituted by an LCD for displaying data or various information inputted from keyboard through LCD connector (LCDC) 51. The display 2 may be a CRT or the like in place of the LCD. The CPU unit is connected with a floppy disk driver 4 through a floppy disk driver connector (FDDC) 52. In place of the floppy disk, a hard disk or external RAM or the like may be connected.

The CPU unit may be connected with an interface such as RS232C 54, Centronics 55, MODEM 56 or the like through an interface connector (IFC) 53 to effect control of the recording apparatus 3 by an external controller or to effect communication with external machines.

In accordance with a flow chart of FIG. 8, the description will be made as to reciprocal printing position adjusting method and print inclination (inclination of the head cartridge 6) adjusting method.

Figures 9A, 9B, 9C:
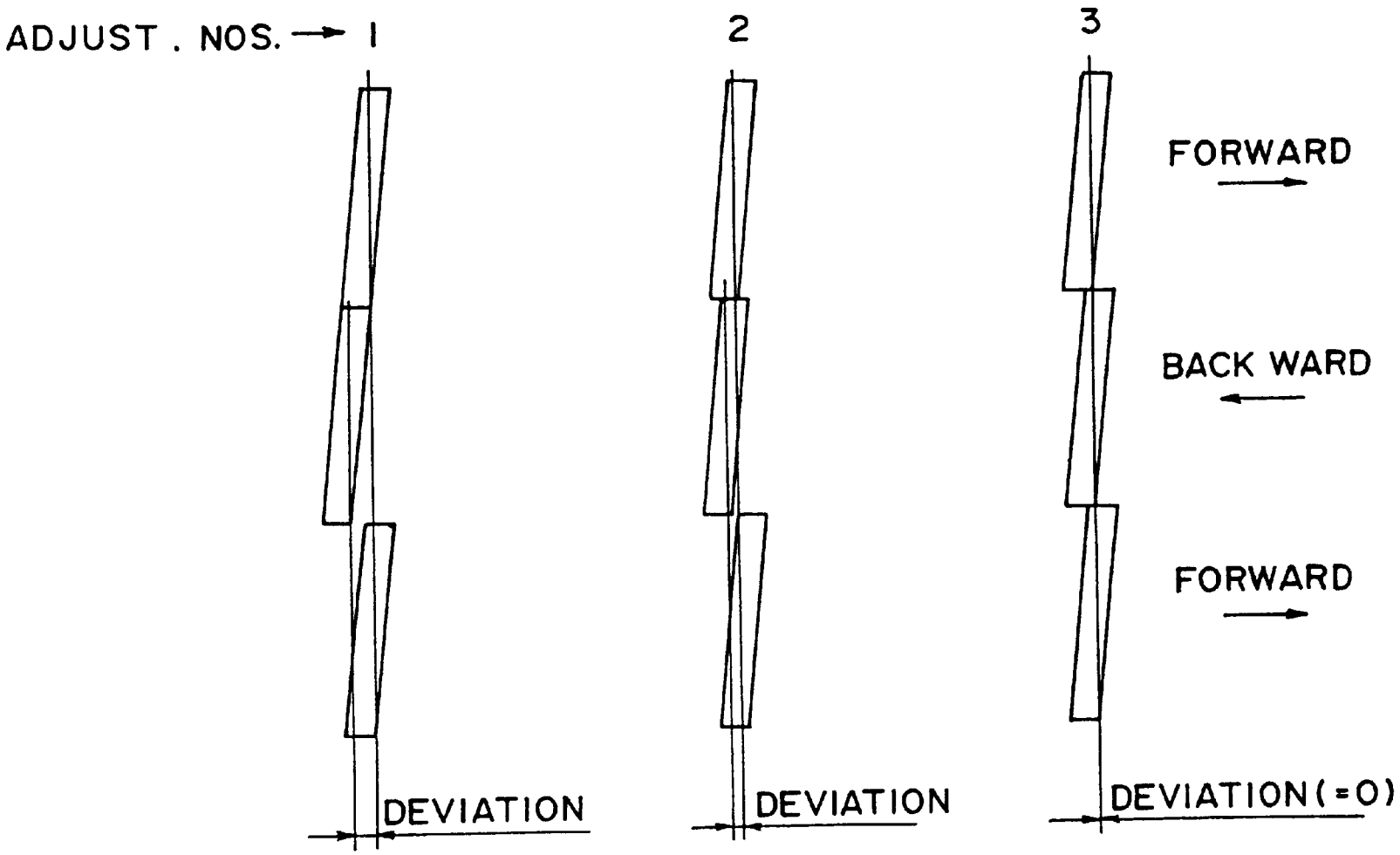
FIGS. 9A–9C show adjusting patterns in the embodiment.
Figure 10:
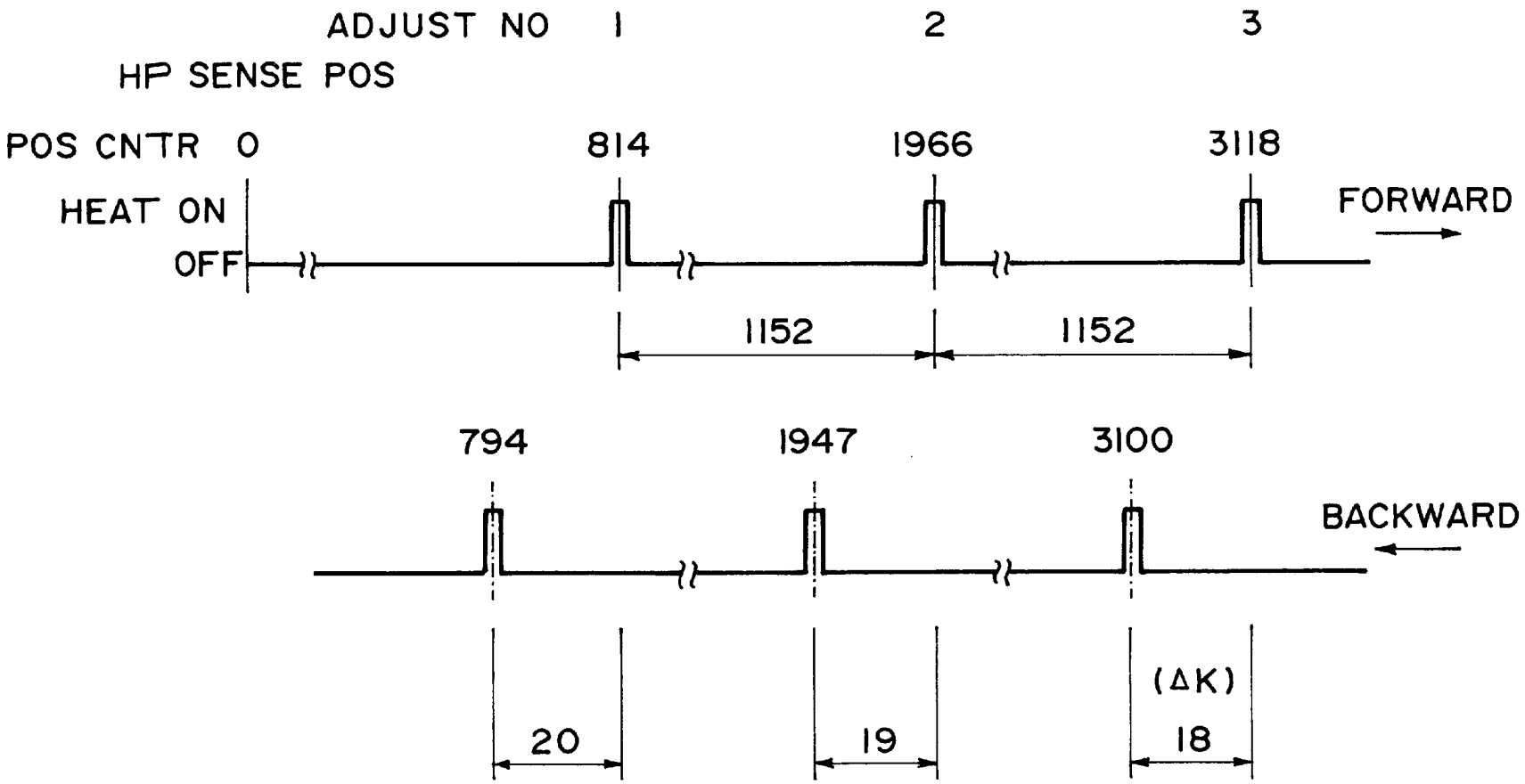
FIG. 10 shows a heat timing when the adjusting pattern of this embodiment is printed.
Figures 11A, 11B, 11C, 11D, 11E, 11F, 11G, 11H:
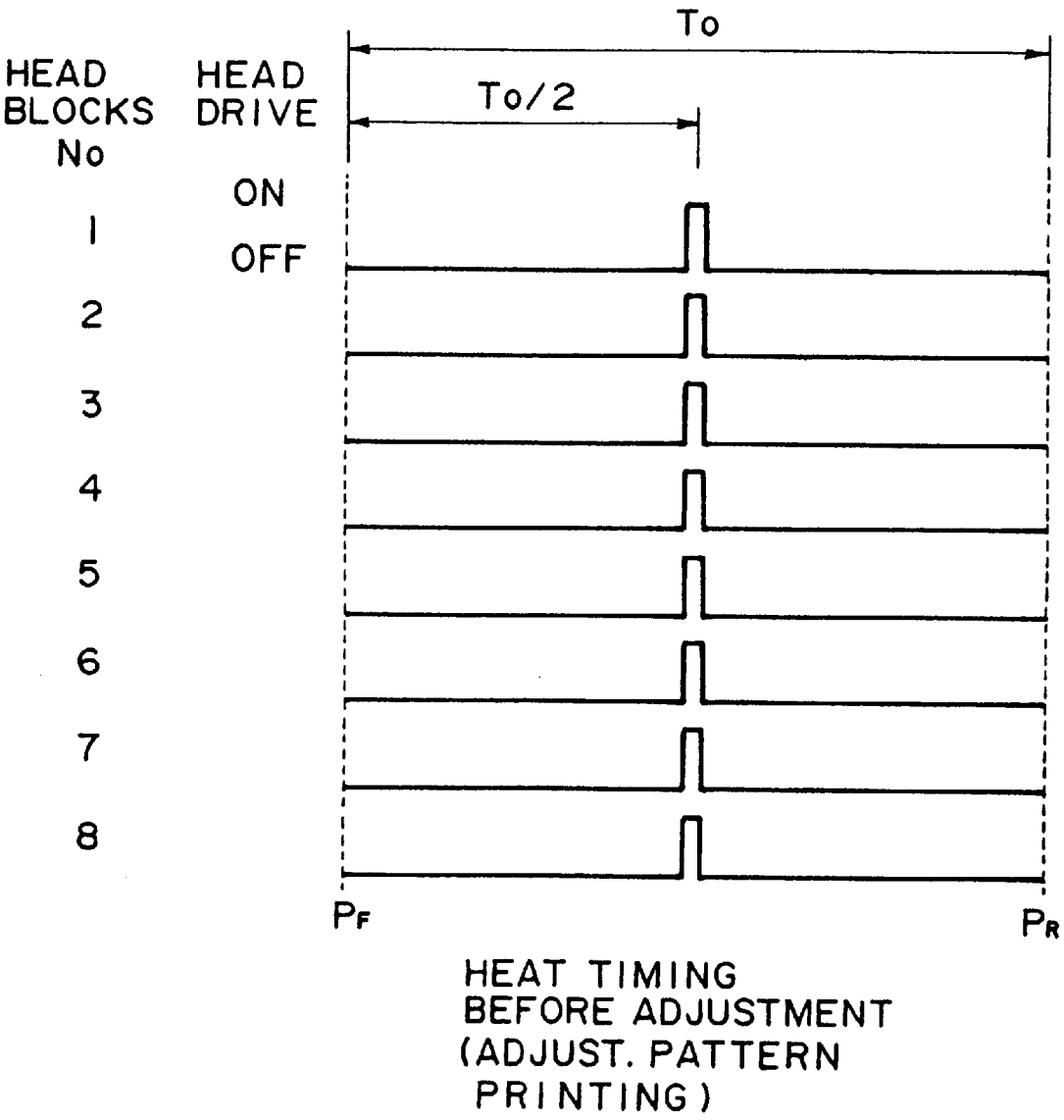
FIGS. 11A–11H show a heat timing prior to effecting the print inclination adjustment, according to the embodiment.
Figures 12A, 12B, 12C, 12D, 12E, 12F, 12G, 12H:
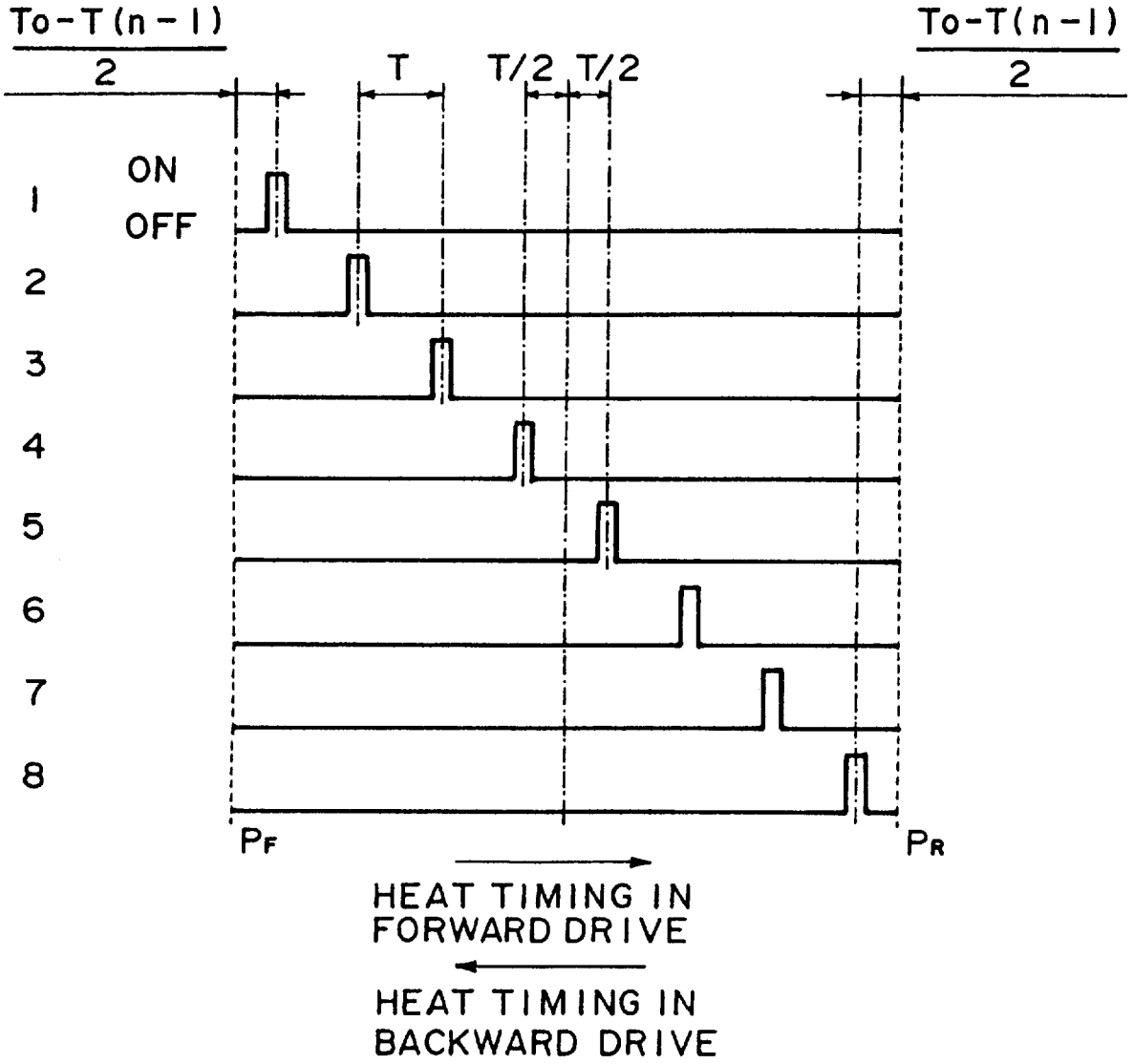
FIGS. 12A–12H show a heat timing after the adjustment.

When a reciprocal printing position adjusting program is executed, the adjusting pattern shown in FIGS. 9A–9C is printed. The adjustment pattern of this embodiment is printed in accordance with a heat timing of FIG. 10.

By an HP sensor 17 (FIG. 2) the home position is determined, and the position counter is reset at this position. The position counter is set in a RAM 43, and is a software counter controlled by the CPU 40. In this embodiment, the carriage motor 16 is in the form of a pulse motor, and the number of pulses supplied to the motor is counted. The carriage 7 is moved in the forward direction while a counter is incremented by one for each one half (720 dpi) of the print resolution in the carriage scanning direction. When the counter counts 814, 1966 and 3118, the recording element of the recording head 6 is driven, and the vertical lines are printed corresponding to adjustment numbers 1, 2 and 3 (FIGS. 9A–9C, line 1, forward print).

Then, the carriage movement direction is reversed, and simultaneously, the recording material is fed through a distance which is equal to the length of the vertical line. Then, the carriage is moved in the backward direction while decrementing the counter by one for each one half the print resolution in the carriage scanning direction. When the count reaches 3100, 1947, 794, the vertical lines are printed (FIGS. 9A–9C, line 2, backward). Further, the carrier movement direction is reversed, and simultaneously, the recording material is fed through a distance which is equal to the length of the vertical line. Then, the carriage is moved to the forward direction. When the count reaches 814, 1966, 3118, the vertical lines are printed again (FIGS. 9A–9C, line 3, forward).

By doing so, the backward print can be shifted by one half the resolution in the carriage scanning direction to the right on the printed surface, relative to the forward print, for each one increment of the adjustment number (step S1). The drive timing of the recording head at this time is such that the head block numbers 1–8 are simultaneously driven at a center T0/2 of a period T0/print resolution in the carriage scanning direction, as shown in FIGS. 11A–11H.

Subsequently, the printed adjustment pattern is checked (step S2) to obtain an adjustment number x where the lines are aligned in one reciprocation (between first line and the second line), and an adjustment number y at which the vertical line is most linear in the 1.5 reciprocation (3 lines). In this embodiment, x is 1, and y is 3. Then, the adjustment number x and the adjustment number y are respectively inputted (step S4).

Therefore, a reciprocal print position adjustment value δK is determined on the basis of the adjustment number y (step S5). In this embodiment, the adjustment value δK=18, corresponding to the adjustment number 3, where δK is a difference between a drive reference (PF) in the forward printing and a drive reference (PR) in the backward printing, as shown in FIGS. 12A–12H. During the forward printing, the printing operation is carried out in accordance with the counts, but during the backward printing, the printing is effected to a position corresponding to the position counter minus 18 (=δK), by doing so, the forward and backward printing positions are in accord with each other. In this embodiment, the count during the backward printing is adjusted on the basis of the count during the forward printing, but it is a possible alternative that the forward count is adjusted on the basis of the count during the backward printing.

In order to adjust the print inclination, the heat timing (drive timing) Tm for each head block (m=1–8, in this embodiment) is calculated (step S6).

$$T=(y-x)/2\times(T0)\times(1/n)$$

where T0 is a dive period of the recording element per unit print resolution in a carriage scanning direction, and T is a heat timing difference between adjacent head blocks, and n is the number of head blocks, that is 8 in this embodiment, and (y−x) corresponds to δK difference (18 and 20 in this example), and it represents amount of inclination with a unit which is equal to one half the resolution. Therefore, (y−x)/2 represents an amount of inclination with the unit of resolution (dot).

As shown in FIGS. 12A–12H, the heat timing after the adjustment is such that the heat timing between blocks is divided with deviation T with the center which is in accord with the center of the period T0 per print resolution in the carriage scanning direction.

When T>0, the head blocks are driven during the forward stroke in the order of 1–8 (from downstream to the upstream), and during the backward printing, they are driven in the order of 8–1 (from the upstream to the downstream). Therefore, during the forward printing, the respective head blocks are driven in the following timings on the basis of the forward print reference count position (PF):

No. 1 block: T1={T0−T×(n−1)}/2

No. 2 block: T2=T2+T

No. 3 block: T3=T2+T

No. 4 block: T4=T3+T

No. 5 block: T5=T4+T

No. 6 block: T6=T5+T

No. 7 block: T7=T6+T

No. 8 block: T8=T7+T

During the backward printing, the head blocks are driven on the basis of the backward print reference count position (PR):

No. 8 block: T8={T0−T×(n−1)}/2

No. 7 block: T7=T8+T

No. 6 block: T6=T7+T

No. 5 block: T5=T6+T

No. 4 block: T4=T5+T

No. 3 block: T3=T4+T

No. 2 block: T2=T3+T

No. 1 block: T1=T2+T

When T<0, the head blocks are driven in the forward printing in the order No. 8–No. 1 and during the backward printing, it is in the order of No. 1–No. 8. Therefore, during the forward printing, the head blocks are driven at the timing on the basis of the forward print reference counter position (PF):

No. 8 block: T8={T0−T−(n−1)}/2

No. 7 block: T7=T8+T

No. 6 block: T6=T7+T

No. 5 block: T5=T6+T

No. 4 block: T4=T5+T

No. 3 block: T3=T4+T

No. 2 block: T2=T3+T

No. 1 block: T1=T2+T

During the backward printing, the head blocks are driven at the following timings on the basis of the backward printing reference count position (PR):

No. 1 block: T1={T0−T×(n−1)}/2

No. 2 block: T2=T1+T

No. 3 block: T3=T2+T

No. 4 block: T4=T3+T

No. 5 block: T5=T4+T

No. 6 block: T6=T5+T

No. 7 block: T7=T6+T

No. 8 block: T8=T7+T

Then, the print inclination correction value and the reciprocal print position correction value are stored in storing means such as EEPROM or the like (step S7). Thus, the adjustment is completed.

Figure 13A:
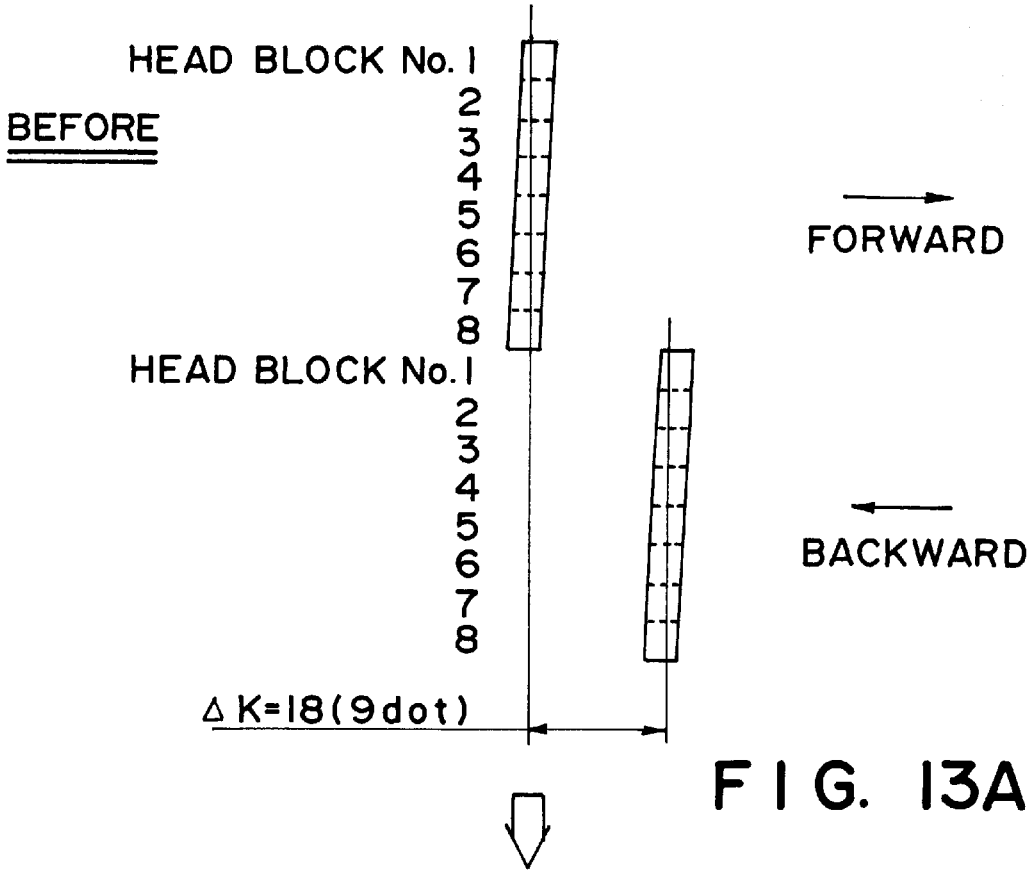
FIGS. 13A and 13B show results of printing before and after the printing inclination adjustment and the reciprocal or bi-directional printing position adjustment, according to the embodiment.
Figure 13B:
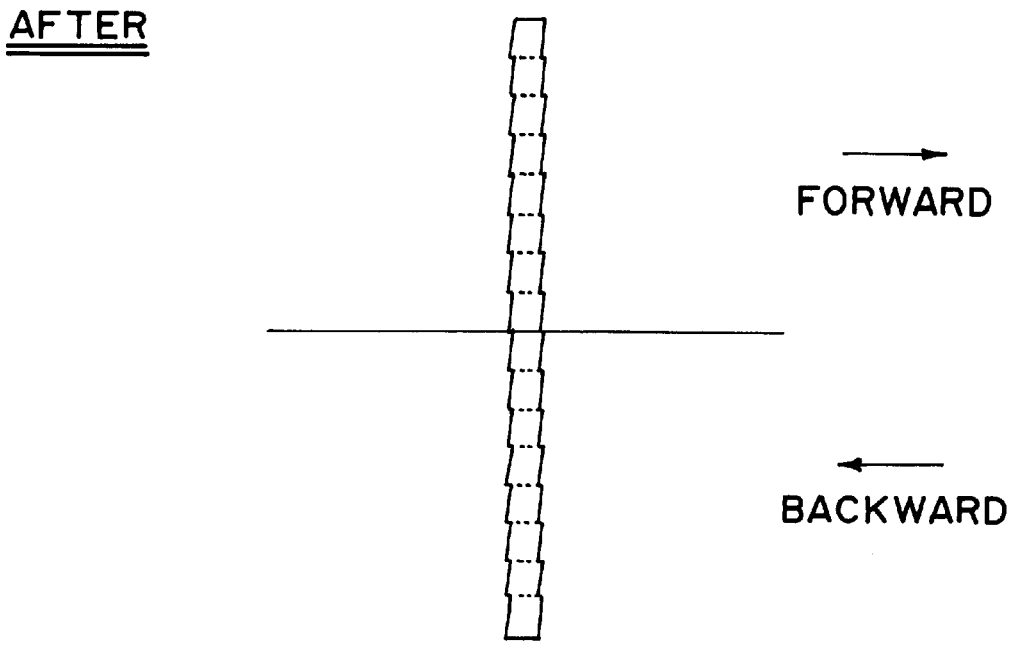
Figure 14:
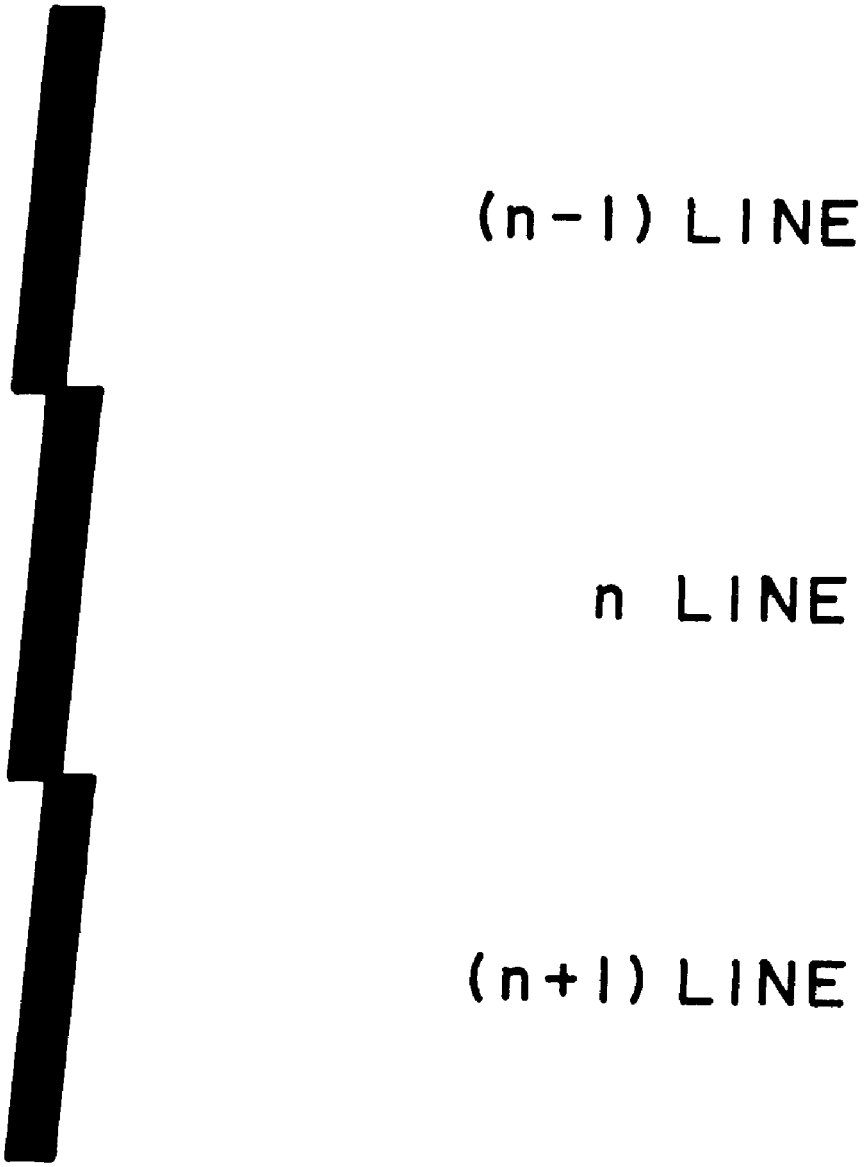
FIG. 14 shows results of printing when there is printing inclination.
Figure 15A:
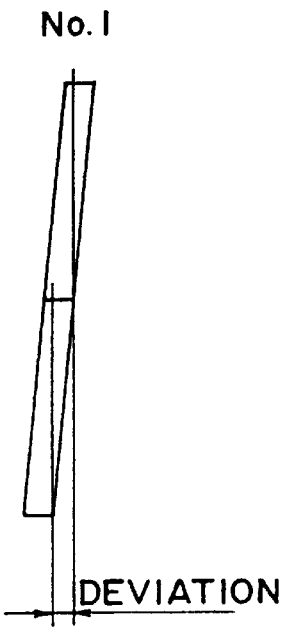
FIGS. 15A–15C show adjusting patterns in a conventional reciprocation adjustment.
Figure 15B:
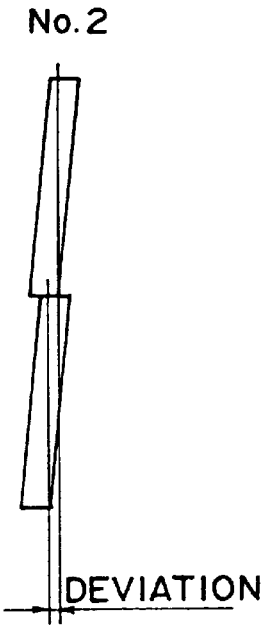
Figure 15C:
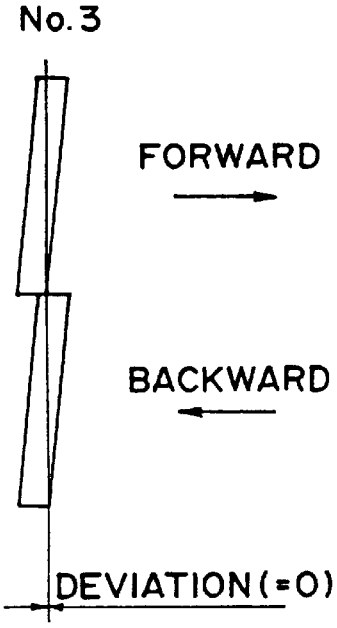

By effecting the adjustment, as shown in FIGS. 13A and 13B, the print before adjustment shown in FIG. 13A, can be adjusted to the state shown in FIG. 13B, without difficulty and for both of the print inclination and the reciprocal printing position. In FIG. 13B, the recording is time shared as shown in FIG. 12, and therefore, the recording positions are deviated in the scanning direction in accordance with the time difference due to the time sharing, and the print inclination can be adjusted (correction).

In this embodiment, one block is formed by 8 recording elements (8 nozzles). However, the present invention is not limited to this, and one block may be constituted by one or more recording elements. By reducing the number of recording elements per block, the inclination can be more finely corrected.

In this embodiment, both of the print inclination and the reciprocal printing position are adjusted using the reciprocal printing. However, it is a possible alternative that only reciprocal printing position is adjusted. It is a possible alternative that only the print inclination is adjusted by printing the adjustment pattern in one direction.

In this embodiment, as shown in FIGS. 11A–11H, adjustment patterns consisting of 8 blocks are simultaneously printed, but if the voltage source capacity is not enough to effect the simultaneous printing, the time shared printing operation shown in FIGS. 12A–12H is possible.

As described in the foregoing, according to the embodiment, as shown in FIG. 9, an adjustment pattern comprising at least three lines including a plurality of vertical lines and in which the relative positions in the carriage scanning direction between the odd number line and the even number line are deviated by small distance, is printed; and by obtaining the adjustment number where the vertical lines are aligned between two lines (adjustment No. 1) and an adjustment number where the entirety of the vertical lines constitute most linear line by three or more lines (adjustment No. 3), are discriminated, by which amount of print inclination is easily calculated.

In addition, the adjust patterns are printed on odd number lines and an even number line or lines in each of forward printing and backward printing (or in the backward printing and forward printing), and the adjustment number where the vertical lines constitute the most linear line by three or more lines, is obtained, by which the reciprocal printing position adjustment is correctly performed.

Another Embodiment

Figure 16:
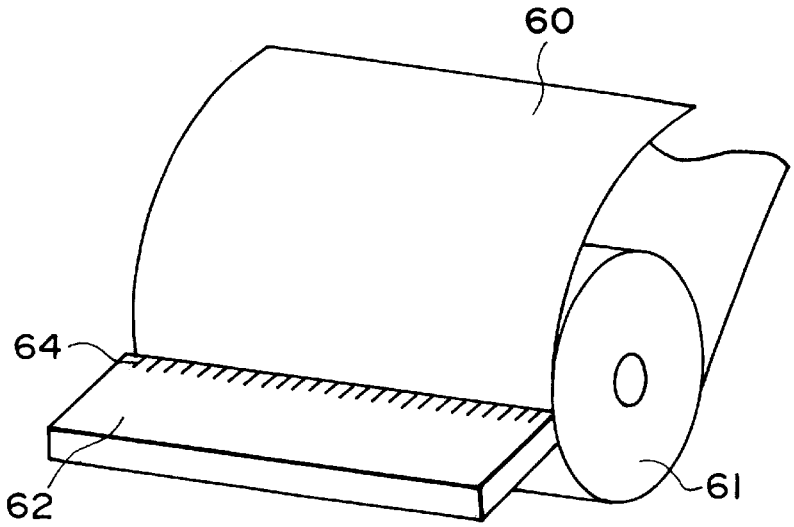
FIG. 16 illustrates a full-line recording apparatus according to another embodiment of the present invention.
Figure 17:
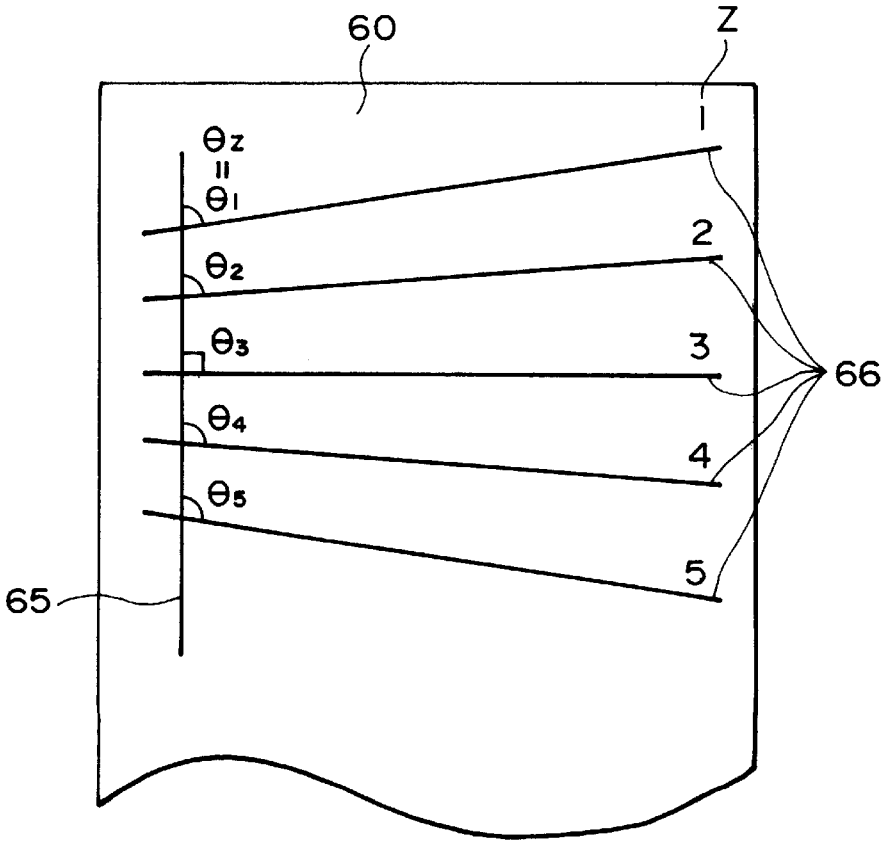
FIG. 17 shows an adjustment pattern usable with a full-line recording apparatus, according to the embodiment.

FIG. 16 illustrates a full-line recording apparatus according to another embodiment of the present invention, and FIG. 17 shows an adjustment pattern.

Designated by reference numeral 60 is a recording sheet of paper; 61, a feed roller for feeding and supporting the recording sheet 60; and 62, a full-line recording head covering substantially the entire recording sheet, and a plurality of recording elements 64 are aligned on a line at a position faced to the recording sheet 60.

As shown in FIG. 17, the adjustment pattern is such that at least one straight line 65 is printed in the recording sheet feeding direction, and that a plurality of lines are printed for which the drive timing of the recording element is sequentially changed in accordance with the position of the recording element so that the inclination θz (z=1–5 in this embodiment) is changed with small increment, in a direction crossing with the line 65. Then, the adjustment number where θz is closest to right angle in the printed pattern is discriminated. In this embodiment, it is adjustment No. 3 (z=3). Furthermore, the adjustment number is registered, by which the drive timing corresponding to the arrangement of the recording elements in the adjustment number z, is stored in the memory means in EEPROM or the like. Thus, the adjustment is completed.

After the adjustment, the printing operation is carried out in accordance with the drive timing stored in the storing means, and the resultant prints are substantially free from print inclination.

The present invention is usable with any ink jet apparatus, such as those using electromechanical converters such as piezoelectric elements, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to a plurality of ink materials having different recording colors or densities. The present invention is effectively applicable to an apparatus having at least one of a monochromatic mode for recording mainly with black, a multi-color mode with different color ink materials and/or a full-line color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, there is provided a high print quality recording apparatus without vertical line deviation due to the print inclination. In addition, the present invention provides a bi-directional printer substantially without print inclination or reciprocal print position deviation, and therefore, high quality printing is possible.

While the invention has been described with reference to the structure disclosed herein, it is not confined to the details set forth and this application is intended to cover such modifications or changes as may come within the purposes of the improvements or the scope of the following claims.

What is claimed is:

1. A recording apparatus for printing on a recording medium by reciprocating a recording head having a linear array of recording elements along a main scanning direction to allow printing during both forward and backward scans of the recording head and effecting relative movement between the recording head and the recording medium in a subscanning direction between scans of the recording head in the main scanning direction, comprising:

means for causing the recording head to print a plurality of adjustment patterns extending in a direction substantially perpendicular to the main scanning direction by causing the recording head to print consecutive parts of each adjustment pattern in consecutive forward and backward scans of the recording head in the main scanning direction so that each adjustment pattern comprises three parts with the middle of the three parts being printed during scanning of the recording head in a direction opposite of that for the other two parts and with driving timings of the recording elements being selected so that different adjustment patterns have different degrees of misalignment in the main scanning direction between the middle part and the other two parts of the adjustment pattern; and means for controlling the drive timings of the recording elements during recording of an image based on the adjustment pattern which most closely resembles a straight line in the subscanning direction.

2. An apparatus according to claim 1, wherein said controlling means adjusts inclination based on an adjustment pattern of the plurality of adjustment patterns where vertical lines of two parts are aligned.

3. An apparatus according to claim 1, wherein the recording elements are grouped into a plurality of blocks which can be simultaneously driven, and said controlling means adjusts the drive timings in accordance with a deviation in the adjustment patterns for each block.

4. An apparatus according to claim 1, further comprising the recording head.

5. An apparatus according to claim 4, wherein said recording head is inclined by a predetermined angle relative to the main scanning direction.

6. An apparatus according to claim 4, wherein said recording head ejects ink.

7. An apparatus according to claim 4, wherein the recording elements of said recording head eject ink using thermal energy.

8. An apparatus according to claim 4, wherein said recording head is exchangeably mounted on said recording apparatus.

9. An apparatus according to claim 4, wherein said recording head is permanently mounted on said recording apparatus.

10. An apparatus according to claim 1, further comprising a carriage for mounting the recording head.

11. An apparatus according to claim 1, further comprising feeding means for feeding a recording material on which the recording head is arranged to effect a printing operation.

12. An apparatus according to claim 1, wherein said recording apparatus comprises a copying machine.

13. An apparatus according to claim 1, wherein said recording apparatus comprises a facsimile machine.

14. An apparatus according to claim 1, wherein said recording apparatus comprises an end unit of a computer.

15. A method for printing on a recording medium by reciprocating a recording head having a linear array of recording elements along a main scanning direction to allow printing during both forward and backward scans of the recording head and effecting relative movement between the recording head and the recording medium in a subscanning direction between scans of the recording head in the main scanning direction, said method comprising the steps of:

causing the recording head to print a plurality of adjustment patterns extending in a direction substantially perpendicular to the main scanning direction by causing the recording head to print consecutive parts of each adjustment pattern in consecutive forward and backward scans of the recording head in the main scanning direction so that each adjustment pattern comprises three parts with the middle of the three parts being printed during scanning of the recording head in a direction opposite of that for the other two parts and with driving timings of the recording elements being selected so that different adjustment patterns have different degrees of misalignment in the main scanning direction between the middle part and the other two parts of the adjustment pattern; and controlling the drive timings of the recording elements during recording of an image based on the adjustment pattern which most closely resembles a straight line in the subscanning direction.

16. A method according to claim 15, further comprising recording with a recording head which ejects ink.

17. A method according to claim 16, wherein the recording elements of the recording head eject ink by using thermal energy.

* * * * *

UNITED STATES PATENT AND TRADEMARK OFFICE

CERTIFICATE OF CORRECTION

PATENT NO. : 6,039,427

DATED : March 21, 2000

INVENTOR(S) : KANOME

It is certified that error appears in the above-identified patent and that said Letters Patent is hereby corrected as shown below:

References Cited:

U.S. PATENT DOCUMENTS, the following should be inserted:

| | | |
|---|---|---|
| --4,313,124 | 1/1982 | Hara |
| 4,345,262 | 8/1982 | Shirato, et al. |
| 4,459,600 | 7/1984 | Sato, et al. |
| 4,463,359 | 7/1984 | Ayata, et al. |
| 4,558,333 | 12/1985 | Sugitani, et al. |
| 4,608,577 | 8/1986 | Hori |
| 4,723,129 | 2/1988 | Endo, et al. |
| 4,740,796 | 4/1988 | Endo, et al.--. |

FOREIGN PATENT DOCUMENTS, the following should be inserted:

| | | |
|---|---|---|
| --54-56847 | 5/1979 | Japan |
| 59-123670 | 7/1984 | Japan |
| 59-138461 | 8/1984 | Japan |
| 60-71260 | 4/1985 | Japan--. |

"02190367" should read --2-190367--.
"02243373" should read --2-243373--.
"03146378" should read --3-146378--.
"03234668" should read --3-234668--.

In the Drawings:

Sheet 7, Figure 7, element 1, "KEY BOARD" should read --KEYBOARD--.

Figure 8:
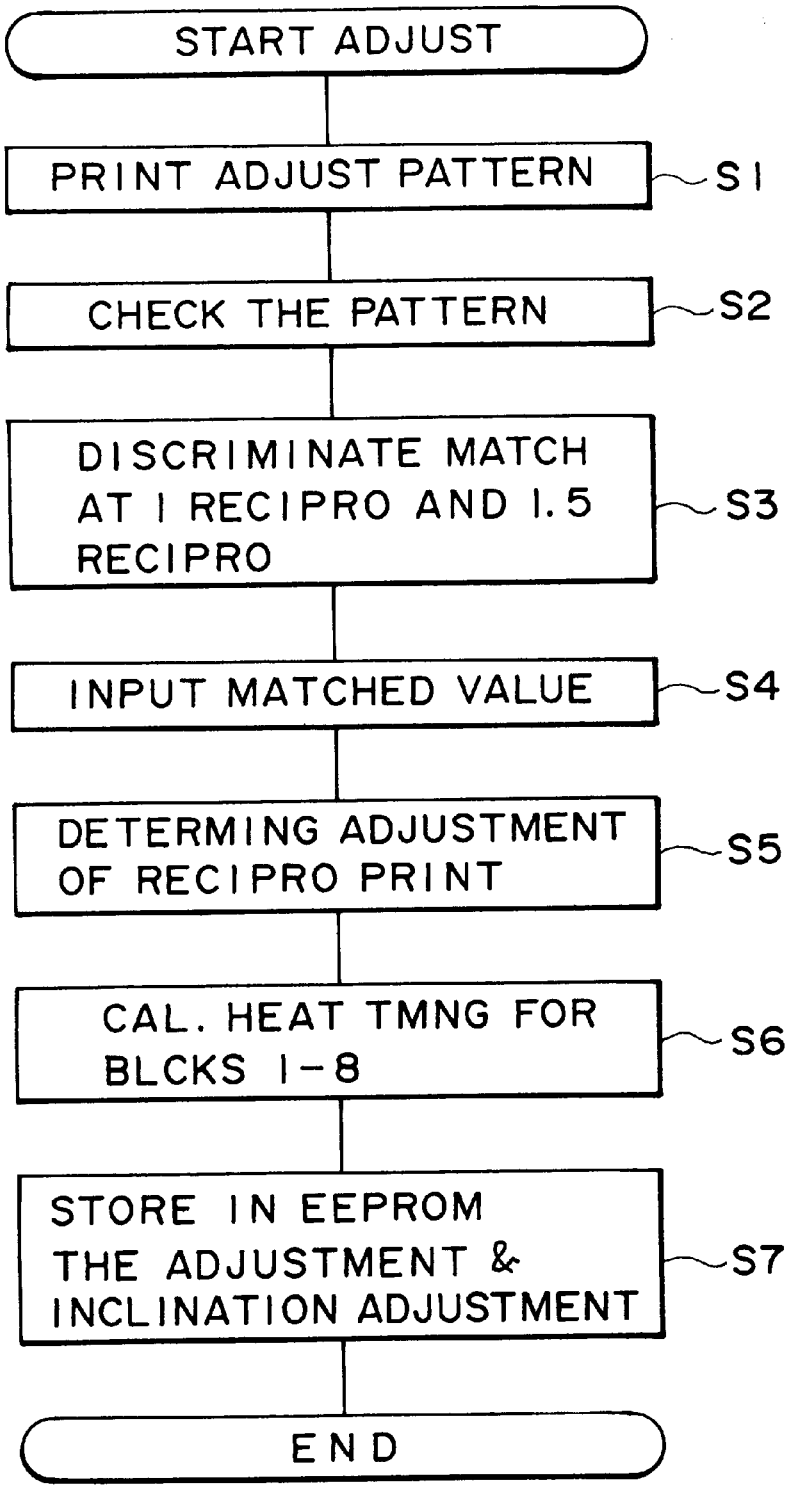
FIG. 8 is a flow chart illustrating a process of carriage driving.

Sheet 8, Figure 8, step S5, "DETERMING" should read --DETERMINING--.

Sheet 9, Figure 9C, "BACK WARD" should read --BACKWARD--.

COLUMN 1:

Line 56, "in" should be deleted.

UNITED STATES PATENT AND TRADEMARK OFFICE

CERTIFICATE OF CORRECTION

PATENT NO. : 6,039,427

DATED : March 21, 2000

INVENTOR(S) : KANOME

It is certified that error appears in the above-identified patent and that said Letters Patent is hereby corrected as shown below:

COLUMN 8:
Line 35, "(=δK)," should read --(=-δK),--.

COLUMN 9:
Line 2, "No. 2 block: T2=T2+T" should read --No. 2 block: T2=T1+T--.
Line 28, "T8={T0-T-(n-1)}/2" should read --T8={T0-T x(n-1)}/2--.

COLUMN 10:
Line 1, "of" should be deleted.

COLUMN 11:
Line 66, "recording head mountable," should read --mountable recording head,--.

COLUMN 12:
Line 30, "through holes" should read --through-holes--.
Line 39, "computer" should read --a computer--.

Signed and Sealed this

Tenth Day of April, 2001

*Attest:*

Nicholas P. Godici

NICHOLAS P. GODICI

*Attesting Officer*

*Acting Director of the United States Patent and Trademark Office*